US009041276B2

(12) United States Patent
Hu

(10) Patent No.: US 9,041,276 B2
(45) Date of Patent: May 26, 2015

(54) REFLECTIVE ANODE STRUCTURE FOR A FIELD EMISSION LIGHTING ARRANGEMENT

(75) Inventor: Qiu-Hong Hu, Göteborg (SE)

(73) Assignee: LIGHTLAB SWEDEN AB, Stockholm (SE)

( * ) Notice: Subject to any disclaimer, the term of this patent is extended or adjusted under 35 U.S.C. 154(b) by 0 days.

(21) Appl. No.: 13/516,197

(22) PCT Filed: Nov. 29, 2010

(86) PCT No.: PCT/EP2010/068420
§ 371 (c)(1),
(2), (4) Date: Sep. 25, 2012

(87) PCT Pub. No.: WO2011/076523
PCT Pub. Date: Jun. 30, 2011

(65) Prior Publication Data

US 2013/0015758 A1 Jan. 17, 2013

(30) Foreign Application Priority Data

Dec. 22, 2009 (EP) ..... 09180339

(51) Int. Cl.
*H01J 1/62* (2006.01)
*H01J 63/04* (2006.01)
(Continued)

(52) U.S. Cl.
CPC ..... *H01J 63/02* (2013.01)

(58) Field of Classification Search
CPC ..... H01J 63/02; H01J 31/02; H01J 31/06; H01J 21/20; H01J 19/24; H01J 1/42; H01J 1/304
USPC ..... 313/495–497, 309
See application file for complete search history.

(56) References Cited

U.S. PATENT DOCUMENTS 2,907,909 A 7/1957 Kazuk
4,737,683 A 4/1988 Shichao et al.
(Continued)

FOREIGN PATENT DOCUMENTS

EP 1498931 A1 1/2005
EP 1744343 A1 1/2007
(Continued)

OTHER PUBLICATIONS

International Search Report & Written Opinion of International Searching Authority.
(Continued)

*Primary Examiner* — Anh Mai
*Assistant Examiner* — Zachary J Snyder
(74) *Attorney, Agent, or Firm* — Harness, Dickey & Pierce, P.L.C.

(57) ABSTRACT

The present invention relates to a field emission lighting arrangement, comprising a first field emission cathode, an anode structure comprising a phosphor layer, and an evacuated envelope inside of which the anode structure and the first field emission cathode are arranged, wherein the anode structure is configured to receive electrons emitted by the first field emission cathode when a voltage is applied between the anode structure and the first field emission cathode and to reflect light generated by the phosphor layer out from the evacuated chamber.
Advantages of the invention include lower power consumption as well as an increase in light output of the field emission lighting arrangement.

12 Claims, 2 Drawing Sheets

(51) Int. Cl.
*H01J 1/02* (2006.01)
*H01J 63/02* (2006.01)

(56) References Cited

U.S. PATENT DOCUMENTS

| | | | | |
|---|---|---|---|---|
| 2001/0024086 | A1* | 9/2001 | Fox et al. | 313/495 |
| 2002/0070648 | A1* | 6/2002 | Forsberg | 313/309 |
| 2003/0058647 | A1 | 3/2003 | Kokubo et al. | |
| 2004/0145299 | A1* | 7/2004 | Wang et al. | 313/497 |
| 2005/0174059 | A1 | 8/2005 | Obratzsov | |
| 2007/0291019 | A1 | 12/2007 | Jung et al. | |
| 2008/0036361 | A1 | 2/2008 | Tsai et al. | |
| 2008/0136312 | A1 | 6/2008 | Wei et al. | |
| 2009/0167140 | A1 | 7/2009 | Hu | |
| 2011/0018427 | A1 | 1/2011 | Hu et al. | |

FOREIGN PATENT DOCUMENTS

| | | | |
|---|---|---|---|
| EP | 1870925 | A2 | 12/2007 |
| EP | 2079095 | A1 | 7/2009 |
| EP | 2337432 | A1 | 6/2011 |
| JP | 2005174852 | A | 6/2005 |
| JP | 2008-060082 | A | 3/2008 |
| JP | 2009129683 | A | 6/2009 |
| TW | 200947505 | A | 11/2009 |
| WO | WO-2005074006 | A1 | 8/2005 |
| WO | WO-2009/132769 | A1 | 11/2009 |

OTHER PUBLICATIONS

Taiwanese Office Action and Search Report dated Sep. 10, 2014, issued in Taiwanese Patent Applicaiton No. 099141282.
Japanese Office Action issued in Japanese Patent Application No. 2012-545195, mailed Jul. 29, 2014.

* cited by examiner

REFLECTIVE ANODE STRUCTURE FOR A FIELD EMISSION LIGHTING ARRANGEMENT

TECHNICAL FIELD

The present invention relates to a field emission lighting arrangement. More specifically, the invention relates to a reflective anode structure for a field emission lighting arrangement.

BACKGROUND OF THE INVENTION

There is currently a trend in replacing the traditional light bulb with more energy efficient alternatives. Florescent light sources also in forms resembling the traditional light bulb have been shown and are often referred to as compact fluorescent lamps (CFLs). As is well known, all florescent light sources contain a small amount of mercury, posing problems due to the health effects of mercury exposure. Additionally, due to heavy regulation of the disposal of mercury, the recycling of florescent light sources becomes complex and expensive.

Accordingly, there is a desire to provide an alternative to florescent light sources. An example of such an alternative is provided in WO 2005074006, disclosing a field emission light source containing no mercury or any other health hazardous materials. The field emission light source includes an anode and a cathode, the anode consists of a transparent electrically conductive layer and a layer of phosphors coated on the inner surface of a cylindrical glass tube. The phosphors are luminescent when excited by electrons. The electron emission is caused by a voltage between the anode and the cathode. For achieving high emission of light it is desirable to apply the voltage in a range of 4-12 kV.

The field emission light source disclosed in WO 2005074006 provides a promising approach to more environmentally friendly lighting, e.g. as no use of mercury is necessary. However it is always desirable to improve the design of the lamp to prolong the life time, and/or to increase the luminous efficiency of the lamp.

SUMMARY OF THE INVENTION

According to an aspect of the invention, the above is at least partly met by a field emission lighting arrangement, comprising a first field emission cathode, an anode structure comprising a phosphor layer, and an evacuated (preferably transparent glass) envelope, inside which the anode structure and the first field emission cathode are arranged, wherein the anode structure is configured to receive electrons emitted by the first field emission cathode when a voltage is applied between the anode structure and the first field emission cathode and to reflect light generated by the phosphor layer out from the envelope.

As a comparison, prior art field emission lighting arrangements are configured such that, during operation, the cathode emits electrons, which are accelerated toward the phosphor layer. The phosphor layer may provide luminescence when the emitted electrons collide with phosphor particles. Light provided from the phosphor layer must transmit through the anode layer and the glass. The luminescence process is accompanied by the production of heat. The only way to dissipate the heat is by means of the conduction and radiation from the glass to air. Consequently, the temperature at the anode becomes increasingly high, causes increased power consumption, and shortens the life time of the lamp.

According to the invention, the anode surface is made to reflect light rather than to transmit light. The removal of the transparency requirement on the anode material allows for a wider range in the selection of anode materials with high thermal conductivity such as a metal and/or tailor made composite materials. Accordingly, the anode structure may comprise a better thermally conductive and radiative material than the glass having a reflective coating. The heat will be conducted away from the anode structure to an anode contact acting as a thermal bath. Thus prior art field emission lighting arrangements using anode structures of glass are inadequate for high emission lighting situations as they do not provide the necessary heat dissipation capability.

For enhancing the light emission of the field emission lighting arrangement, the anode structure may be configured to have a first anode unit at least partly covered by the phosphor layer to match a single field emission cathode that is placed at the axis of the cylinder of which the first cylinder is a part. This arrangement allows for a high and uniform light emission. The anode unit of the anode structure may be shaped to circular, parabola or hyperbola or elliptical cross-sectioned arch cylinder, and arch torus of either positive or negative curvature. The phosphors are coated on the anode surface.

The field emission lighting arrangement may further comprise a second field emission cathode, wherein the anode structure has a second anode unit, and the second field emission cathode is arranged at the axis of the cylinder of which the second cylinder is a part. The first anode unit may be at least partly covered by a first phosphor layer and the second anode unit may be at least partly covered by a second phosphor layer. The first and the second phosphor layers are preferably characterized by the fact that they have different light emissive features, such as different dominant wavelengths. At least one of the first and the second phosphor layers may also be configured to emit at least one of green, blue and red light. By providing different sections of the anode structure with different types of phosphor layers, it may be possible to allow for individual control of the different corresponding cathodes and thus for the possibility to mix different types of light being emitted by the different sections of the field emission lighting arrangement. Accordingly, different types of colored light may be provided, as well as white light having different color temperatures, for example by allowing for one section of the anode structure to be provided with a "white light phosphors" and another section of the anode structure to be provided with "red light phosphor". By adjusting the proportion of the red, green and blue phosphors, the color temperature of the output light may be controlled. It is of course possible and within the scope of the invention to include multiple anode units and corresponding field emission cathodes. Preferred embodiments for example include three, four and five circular arcs. The implementation of the anode structure in conjunction with the field emission cathodes are further discussed below in relation to the detailed description of the invention.

For achieving high light output of the field emission lighting arrangement, the first field emission cathode may comprise a carbonized solid compound foam having a continuous cellular structure, the continuous cellular structure providing multiple emission cites for emission of electrons onto the anode when the voltage is applied. Alternatively, the first field emission cathode may comprise ZnO nanostructures grown on a substrate. The selection of the material for the first (as well as the second) field emission cathode may depend on the implementation of the field emission lighting arrangement.

In a preferred embodiment of the invention, the field emission lighting arrangement further comprises a power supply connected to the first field emission cathode and the anode structure configure to provide a drive signal for powering the field emission lighting arrangement, the drive signal having a first frequency, wherein the first frequency is selected to be within a range corresponding to the half power width at resonance of the field emission lighting arrangement. In accordance with the invention, the selection of the first frequency to be such that the half power width at resonance of the field emission lighting arrangement is achieved is understood to mean that the first frequency is selected to be centered around the resonance frequency of the field emission lighting arrangement and having a range such that half of the total power is contained. Put differently, the first frequency is selected to be somewhere within the range of frequencies where drive signal has a power above a certain half the maximum value for its amplitude. This is further discussed in EP09180155, by the applicant, which is incorporated by reference in its entirety.

Advantages with the inclusion of an inductor together with the selection of a drive signal for arranging the field emission lighting arrangement at resonance includes lower power consumption of the field emission lighting arrangement as well as an increase in light output of the field emission lighting arrangement.

It is also possible to provide a power supply connected to the first field emission cathode, the second field emission cathode and the anode structure and configure to provide a drive signal for powering the field emission lighting arrangement, wherein the drive signal is controlled to alternating provide a voltage between the first field emission cathode and the anode structure and the second field emission cathode and the anode structure. This allows for alternating emission of light from within the different sections of anode as well as individual control of light emission from a single unit. Similarly, the units can be put to equal or different electric potentials with respect to the cathodes depending on the implementation of the anode structure.

Preferably, the anode structure comprises a plurality of heat sink flanges for dissipating heat generated during operation of the field emission lighting arrangement. The flanges may for example be arranged in a direction facing inwards from the circular arcs. As noted above, the implementation of the anode structure in conjunction with the field emission cathodes are further discussed below in relation to the detailed description of the invention.

According to another aspect of the invention there is provided an anode structure for a field emission lighting arrangement, comprising a first anode unit, and a phosphor layer, wherein the first anode unit is at least partly covered by the phosphor layer and the anode structure comprises a thermally conductive material having a reflective coating. This aspect of the invention provides similar advantages as the first aspect of the invention.

Preferably, the anode structure comprises at least a second anode unit and heat sink flanges for dissipating heat generated during operation of the field emission lighting arrangement.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
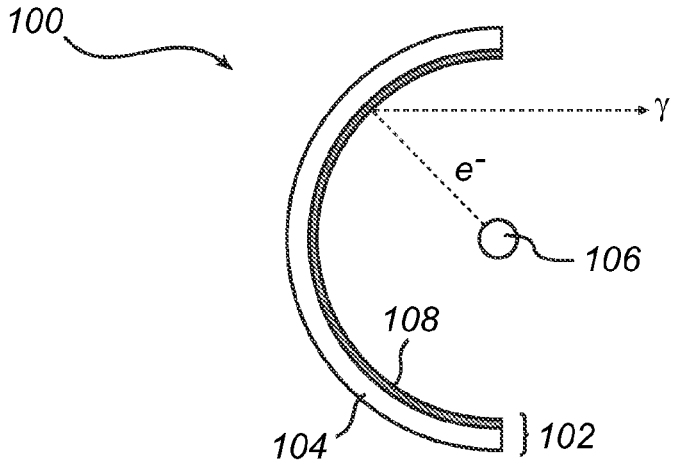
FIG. 1 illustrates a conceptual field emission lighting arrangement comprising an anode structure according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a top view of a conceptual field emission lighting arrangement 100 comprising an anode structure 102 according to a currently preferred embodiment of the invention comprising a heat and electrically conductive member 104, such as a solid metal structure (e.g. copper, aluminum, etc.). The field emission lighting arrangement 100 further comprises a cathode 106, the cathode 106 being arranged at an equal distance from the anode structure 102. Accordingly, the anode structure 102 according to the illustrated embodiment comprises an arc shaped portion (anode unit) facing the cathode 106. The arc shaped portion facing the cathode 106 is at least partly provided with a phosphor layer 108. The anode structure 102 and the cathode 106 are both arranged in an evacuated and at least partly optically transparent envelope (not shown), such as a glass tube.

During operation of the field emission lighting arrangement 100, a high voltage (e.g. 4-12 kV) is applied between the thermally and electrically conductive member 104 of the anode 102 and the cathode 106. Due to the high voltage and the essentially equal distance between the anode structure 102 and the cathode 106, electrons will emit from the cathode 106. The electrons emitted from the cathode 106 will travel towards the thermally and electrically conductive member 104 of the anode 102 to strike the phosphor layer 108 such that light is emitted. The light emitted forward from the phosphor layer 108 will move further in the direction of the thermally and electrically conductive member 104. Depending on the material used together with the thermally and electrically conductive member 104, which preferably is reflective (e.g. a metal, polished metal, reflective layer arranged together with the thermally and electrically conductive member 104, etc.), the light will be reflected by the thermally and electrically conductive member 104 and towards the outside of the field emission lighting arrangement 100. On the other hand, the back-emitted light will travel directly out of the glass envelope.

The process of electron/light conversion will generate heat, and the thermally and electrically conductive member 104 will allow for transfer and/or dissipation of the generated heat. Thus, it is desirable to maximize the bulk material used for the thermally and electrically conductive member 104 such that the temperature at or around the area where the phosphor layer 108 is arranged is kept as low as possible. Accordingly, the thermally and electrically conductive member 104 may further comprise heat flanges for increasing the heat dissipation. Because of 104, a lower temperature can be reached at the area where the phosphor layer 108 is coated to prolong the lifetime of the phosphor, and decrease the power consumption thus to provide improvements to the field emission light source 100 in relation to prior art field emission light sources.

Figure 2:
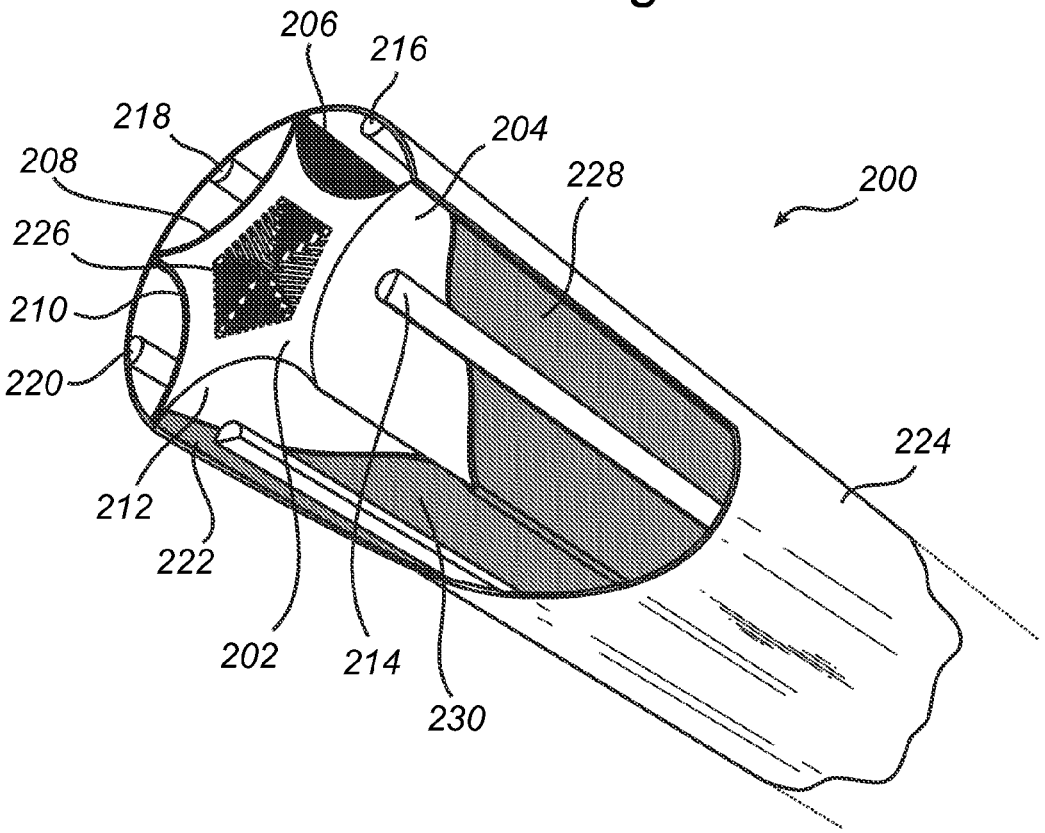
FIG. 2 illustrates another embodiment of a currently preferred embodiment of the inventive field emission lighting arrangement.

Turning now to FIG. 2 which illustrates the concept of the invention in a section of a field emission arrangement 200. The field emission lighting arrangement 200 in FIG. 2 comprises another implementation of the anode structure 102, where the anode structure 202 comprises five anode units 204, 206, 208, 210, 212 facing outwards from a center axis of the anode structure 202. Correspondingly, the field emission lighting arrangement 200 also comprises five individually controllable cathodes 214, 216, 218, 220, 222 arranged at the axis of each of the anode units 204, 206, 208, 210, 212 are a part. The anode structure 202 and the cathodes 214, 216, 218, 220, 222 are again provided in an optical transparent and evacuated glass tube 224. Additionally, the anode structure 202 is hollow at the center axis and provided with heat sink flanges 226 for dissipating heat generated during operation of the field emission lighting arrangement 200.

Furthermore, the respective anode units 204, 206, 208, 210, 212 are each provided with the same and/or a mixture of different phosphors layers (where phosphor layers 228 and 230 are shown and the remaining three phosphor layers are occluded) having the same and/or different features in relation to the electron to light conversion. For example, by combining five different phosphor layers converting electrons to light of essentially white, red, green, blue, and magenta color, it is possible to allow for color and/or color temperature control of the combined light emitted by the field emission lighting arrangement 200. More specifically, during operation, by allowing for individual application of a high voltage between each of the cathodes 214, 216, 218, 220, 222 and the anode structure 202 (e.g. functioning as a combined reference for all of the cathodes 214, 216, 218, 220, 222), it is possible to provide mixed color light.

As an example, if driving the cathode facing the white phosphor layer at full effect, the light emitted by the field emission lighting arrangement 200 will emit white light. If then also driving the cathode facing the blue phosphor layer at e.g. half effect, the field emission lighting arrangement 200 will emit white light having some blue addition, effectively providing white light having a high color temperature (i.e. "cold light"). Correspondingly, by instead driving the cathode facing the white phosphor layer together with the cathode facing the red phosphor layer it is possible to provide light having a low color temperature, i.e. "warm light". Other mixing possibilities are of course possible and within the scope of the invention. Similarly, more or less than five anode units and corresponding cathodes are of course also possible and within the scope of the invention.

Figure 3:
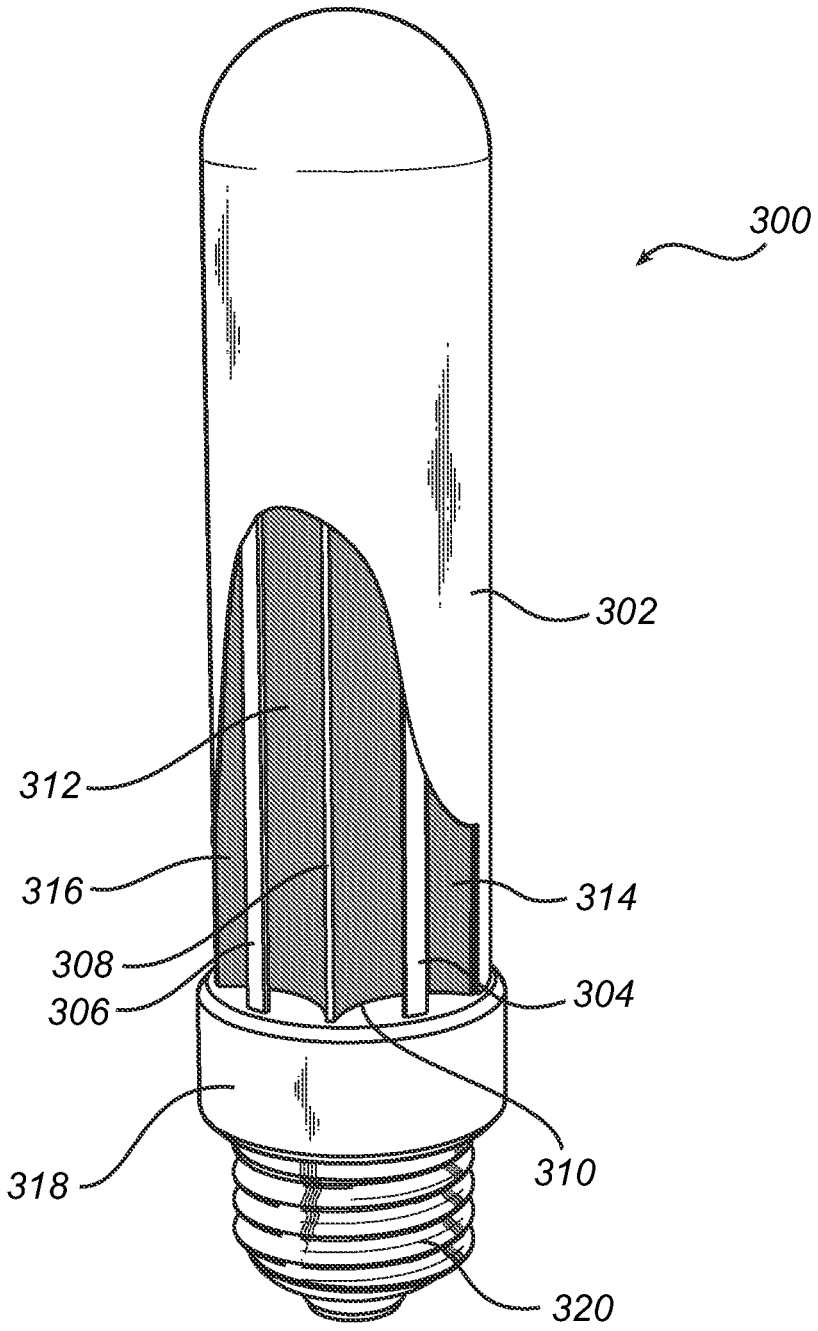
FIG. 3 shows a further possible implementation of a field emission lighting arrangement.

FIG. 3 shows a conceptual illustration of a standalone field emission lighting arrangement 300 according to yet another preferred embodiment of the invention. The field emission lighting arrangement 300 comprises an evacuated cylindrical glass tube 302 inside of which there arranged a plurality of cathodes 304, 306. The field emission lighting arrangement 300 also comprises an anode structure 308, comprising a plurality of anode units 310, 312, each being provided with a phosphor layer 314, 316. The field emission lighting arrangement 300 further comprises a base 318 and a socket 320, allowing for the field emission lighting arrangement 300 to be used for retrofitting conventional light bulbs. The base 318 preferably comprises a control unit for providing controlling the drive signals (i.e. high voltage) to the cathodes 304, 306.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. For example, the shape of the anode structure is in FIGS. 1-3 are shown to be essentially straight. However, it is possible and within the scope of the invention to construct the anode structure (e.g. anode structure 100, 200) to have a different form, for example being essentially curved. In such a case, the cathode(s) need to be adapted to correspond to the shape of the anode structure. Possible embodiments include field emission lighting arrangements having essentially circular/elliptic form.

Furthermore, in the claims, the word "comprising" does not exclude other elements or steps, and the indefinite article "a" or "an" does not exclude a plurality.

The invention claimed is:

1. A field emission lighting arrangement, comprising:

a plurality of individually controllable field emission cathodes;

an anode structure comprising a base material, a phosphor layer on a first side of the base material, and a plurality of heat sink flanges protruding from an opposing second side of the base material, the base material being thermally and electrically conductive and optically reflective, the plurality of heat sink flanges configured to dissipate heat generated during operation of the field emission lighting arrangement;

an evacuated envelope inside of which the anode structure and the plurality of individually controllable field emission cathodes are arranged; and a power supply configured to provide an individual high voltage drive signal to each of the plurality of individually controllable field emission cathodes, wherein the anode structure is configured to receive electrons emitted by a designated one or more of the plurality of individually controllable field emission cathodes when the individual high voltage drive signal is provided to apply a voltage between the anode structure and the designated one or more of the plurality of individually controllable field emission cathodes, and the anode structure is configured to reflect light generated by the phosphor layer out from the evacuated envelope.

2. The field emission lighting arrangement according to claim 1, wherein the anode structure includes a plurality of anode units, each of the plurality of anode units corresponding to one of the plurality of individually controllable field emission cathodes, the plurality of anode units including a first anode unit and a second anode unit, each of the first anode unit and the second anode unit being at least partly covered by the phosphor layer.

3. The field emission lighting arrangement according to claim 2, wherein the phosphor layer includes a first phosphor layer and a second phosphor layer, the first anode unit is at least partly covered by the first phosphor layer, and the second anode unit is at least partly covered by the second phosphor layer.

4. The field emission lighting arrangement according to claim 3, wherein the first phosphor layer is configured to emit light having a first dominant wavelength and the second phosphor layer is configured to emit light having a second dominant wavelength, the first dominant wavelength being different from the second dominant wavelength.

5. The field emission lighting arrangement according to claim 3, wherein at least one of the first and the second phosphor layers are configured to emit at least one of green, blue and red light.

6. The field emission lighting arrangement according to claim 1, wherein the plurality of individually controllable field emission cathodes include a carbonized solid compound foam having a continuous cellular structure, the continuous cellular structure providing multiple emission sites for emission of electrons onto the anode structure when the voltage is applied.

7. The field emission lighting arrangement according to claim 1, wherein the plurality of individually controllable field emission cathodes include ZnO nanostructures grown on a substrate.

8. The field emission lighting arrangement according to claim 1, wherein the power supply is configured to provide the individual high voltage drive signal so as to alternately apply the voltage between each of the plurality of individually controllable field emission cathodes and the anode structure.

9. The field emission lighting arrangement of claim 1, wherein the anode structure includes a plurality of anode units, the plurality of anode units arranged around a center axis of the anode structure.

10. The field emission lighting arrangement of claim 9, wherein each of the plurality of anode units includes a concave surface that faces outward from the center axis of the anode structure.

11. The field emission lighting arrangement of claim 1, wherein plurality of heat sink flanges are surrounded by the base material.

12. The field emission lighting arrangement of claim 1, wherein plurality of heat sink flanges protrude inward toward a center axis of the anode structure.

* * * * *